US010487413B2

(12) United States Patent
Silberbauer et al.

(10) Patent No.: US 10,487,413 B2
(45) Date of Patent: Nov. 26, 2019

(54) SYSTEM FOR INSULATING HIGH CURRENT BUSBARS

(71) Applicant: SCHNEIDER ELECTRIC IT CORPORATION, West Kingston, RI (US)

(72) Inventors: Kristian Silberbauer, Ribe (DK); Claus Aabjerg Andersen, Kolding (DK)

(73) Assignee: SCHNEIDER ELECTRIC IT CORPORATION, West Kingston, RI (US)

( * ) Notice: Subject to any disclaimer, the term of this patent is extended or adjusted under 35 U.S.C. 154(b) by 21 days.

(21) Appl. No.: 15/101,352

(22) PCT Filed: Dec. 3, 2013

(86) PCT No.: PCT/US2013/072839
§ 371 (c)(1),
(2) Date: Jun. 2, 2016

(87) PCT Pub. No.: WO2015/084331
PCT Pub. Date: Jun. 11, 2015

(65) Prior Publication Data

US 2016/0305036 A1 Oct. 20, 2016

(51) Int. Cl.
*C25D 11/02* (2006.01)
*C25D 3/12* (2006.01)
(Continued)

(52) U.S. Cl.
CPC ..... *C25D 11/022* (2013.01); *C23C 18/1603* (2013.01); *C23C 18/1637* (2013.01);
(Continued)

(58) Field of Classification Search
None
See application file for complete search history.

(56) References Cited

U.S. PATENT DOCUMENTS 1,404,674 A 1/1922 Wille
3,257,244 A * 6/1966 Fredrik ..... C25D 11/246 148/273
(Continued)

FOREIGN PATENT DOCUMENTS

CN 1149774 A 5/1997
CN 102691090 A 9/2012
(Continued)

OTHER PUBLICATIONS

Notification of Transmittal of the International Search Report and the Written Opinion of the International Searching Authority from corresponding PCT/US2013/072839 dated Apr. 15, 2014.
(Continued)

*Primary Examiner* — Stephanie S Wittenberg
(74) *Attorney, Agent, or Firm* — Lando & Anastasi, LLP

(57) ABSTRACT

A method of treating a surface of an aluminum busbar includes pre-conditioning the surface of the busbar, anodizing one portion of the surface of the busbar, and plating another portion of the surface of the busbar with at least one metal. A fixture used to secure a busbar for a treatment process is also disclosed.

11 Claims, 5 Drawing Sheets

(51) Int. Cl.

| | |
|---|---|
| ***C25D 3/30*** | (2006.01) |
| ***C25D 5/02*** | (2006.01) |
| ***C25D 5/12*** | (2006.01) |
| ***C25D 11/16*** | (2006.01) |
| ***C25D 11/24*** | (2006.01) |
| ***C23C 18/16*** | (2006.01) |
| ***C23C 18/54*** | (2006.01) |
| ***C23C 18/18*** | (2006.01) |
| ***C23C 18/32*** | (2006.01) |
| ***C23C 28/00*** | (2006.01) |
| ***C25D 17/06*** | (2006.01) |
| ***C25D 11/00*** | (2006.01) |
| *C25D 11/08* | (2006.01) |

(52) U.S. Cl.

CPC ..... *C23C 18/1651* (2013.01); *C23C 18/1653* (2013.01); *C23C 18/1848* (2013.01); *C23C 18/32* (2013.01); *C23C 18/54* (2013.01); *C23C 28/322* (2013.01); *C23C 28/345* (2013.01); *C25D 3/12* (2013.01); *C25D 3/30* (2013.01); *C25D 5/022* (2013.01); *C25D 5/12* (2013.01); *C25D 11/005* (2013.01); *C25D 11/16* (2013.01); *C25D 11/246* (2013.01); *C25D 17/06* (2013.01); *C25D 11/08* (2013.01); *C25D 11/243* (2013.01)

(56) References Cited

U.S. PATENT DOCUMENTS

| | | | | | |
|---|---|---|---|---|---|
| 3,450,606 | A * | 6/1969 | George | C25D 11/14 | 205/121 |
| 3,603,539 | A | 9/1971 | Clegg, Jr. | | |
| 3,641,473 | A | 2/1972 | Attaway | | |
| 3,824,176 | A * | 7/1974 | Crowe | C25D 1/00 | 204/297.05 |
| 4,288,313 | A * | 9/1981 | Bormke | C25D 17/06 | 118/500 |
| 4,681,666 | A | 7/1987 | Potter et al. | | |
| 4,844,779 | A | 7/1989 | Callahan | | |
| 4,955,353 | A * | 9/1990 | Amataka | F02F 3/12 | 123/193.6 |
| 5,759,363 | A * | 6/1998 | Rose | C25D 17/06 | 118/500 |
| 5,866,850 | A | 2/1999 | Kobayashi | | |
| 6,911,139 | B2 | 6/2005 | Heimann et al. | | |
| 8,469,735 | B2 | 6/2013 | Dargatz | | |
| 8,496,767 | B2 | 7/2013 | Kawada | | |
| 9,072,191 | B2 | 6/2015 | Silberbauer et al. | | |
| 2003/0219609 | A1* | 11/2003 | Nishimura | B62K 19/04 | 428/472.2 |
| 2004/0007460 | A1 | 1/2004 | Sagedahl | | |
| 2006/0076241 | A1 | 4/2006 | Schneider et al. | | |
| 2007/0212558 | A1* | 9/2007 | Gao | C25D 5/022 | 428/469 |
| 2007/0221504 | A1* | 9/2007 | Luo | C25D 1/003 | 205/118 |
| 2013/0043135 | A1 | 2/2013 | Demers et al. | | |

FOREIGN PATENT DOCUMENTS

| | | | | |
|---|---|---|---|---|
| CN | 202595307 U | | 12/2012 | |
| CN | 203055950 U | | 7/2013 | |
| DE | 10121584 | * | 6/2002 | H01R 25/14 |
| WO | 2009064060 A1 | | 5/2009 | |

OTHER PUBLICATIONS

Partial Supplementary European Search Report from corresponding European Application No. 13898604.7 dated Sep. 6, 2017.

Extended European Search Report from corresponding European Application No. 13898604.7 dated Feb. 5, 2018.

* cited by examiner

30

32

34

36

38

| Method | Electrolyte | Current | pH | Temperature | Duration |
|---|---|---|---|---|---|
| Degreasing | Mild Alkaline | | ~12 | 50-80°C | 60-300 secs |
| Rinse | | | | | |
| Alkaline Etch | Strong alkaline | | >13 | 60-70°C | 5-120 secs |
| Rinse | | | | | |
| Apply sealing jig | | | | | |
| Rinse | | | | | |
| Desmutting | 50%v/v HNO3 | | <1 | | |
| Rinse | | | | | |
| Anodizing | 20%w/w H2SO4 | 1.2-2A/dm$^2$ | ~1 | 20°C | Minutes |
| Rinse | | | | | |
| Coloring | H2O+dye | | 7-8 | 20°C | |
| Rinse | | | | | |
| Sealing | H2O | | 7-8 | 80-95°C | |
| Rinse | | | | | |
| Teflon | | | | | |
| Rinse | | | | | |
| Remove sealing jig | | | | | |
| Rinse | | | | | |
| Zinc plating | Alzincate EN | | >12 | 21-46°C | 15-120 secs |
| Rinse | | | | | |
| Stripping | 50%v/v HNO3 | | ~1 | 20°C | 5-10 secs |
| Rinse | | | | | |
| 2nd Zinc plating | Alzincate EN | | >12 | 21-46°C | 5-15 secs |
| Rinse | | | | | |
| Nickel plating | Watts bath | 2-6A/dm$^2$ | 3-5 | 46-71°C | Minutes |
| Rinse | | | | | |
| Tin plating | Several choices exist - typical acid based | 1-10A/dm$^2$ | 2-7 | 20-30°C | Minutes |
| Rinse | | | | | |
| Neutralizing | | | | | |
| Rinse | | | | | |
| Post dip | | | | | |

FIG. 3

70 80 82

| Method #1 | Method #2 | Method #3 | Electrolyte | Current | pH | Temperature | Duration |
|---|---|---|---|---|---|---|---|
| Degreasing | Degreasing | Degreasing | Mild Alkaline | | ~12 | 50-80°C | 60-300 secs |
| Rinse | Rinse | Rinse | | | | | |
| Alkaline Etch | Alkaline Etch | Alkaline Etch | Strong alkaline | | >13 | 60-70°C | 5-120 secs |
| Rinse | Rinse | Rinse | | | | | |
| 72 Apply sealing jig | | | | | | | |
| Rinse | | | | | | | |
| Desmutting | Desmutting | Desmutting | 50%v/v HNO3 | | <1 | | |
| Rinse | | | | | | | |
| Anodizing | | | 20%w/w H2SO4 | 1.2-2A/dm² | ~1 | 20°C | minutes |
| Rinse | | | | | | | |
| Coloring | | | H2O+dye | | 7-8 | 20°C | |
| Rinse | | | | | | | |
| Sealing | | | H2O | | 7-8 | 80-95°C | |
| Rinse | | | | | | | |
| Teflon | | | | | | | |
| Rinse | | | | | | | |
| Remove sealing jig | | | | | | | |
| 74 | | | | | | | |
| 84 | | | | | | | |
| Rinse | Rinse | | | | | | |
| Zinc plating | Zinc plating | | Alzincate EN | | >12 | 21-46°C | 15-120 secs |
| Rinse | Rinse | | | | | | |
| Stripping | Stripping | | 50%v/v HNO3 | | ~1 | 20°C | 5-10 secs |
| Rinse | Rinse | | | | | | |
| 2nd Zinc plating | 2nd Zinc plating | | Alzincate EN | | >12 | 21-46°C | 5-15 secs |
| | Rinse | Rinse | | | | | |
| | Apply sealing jig | Apply sealing jig | | | | | |
| | Rinse | | | | | | |
| | Desmutting | | 50%v/v HNO3 | | <1 | | |
| | Rinse | | | | | | |
| 76 | Anodizing | | 20%w/w H2SO4 | 1.2-2A/dm² | ~1 | 20°C | minutes |
| | Rinse | | | | | | |
| | Coloring | | H2O+dye | | 7-8 | 20°C | |
| | Rinse | | | | | | |
| | Sealing | | H2O | | 7-8 | 80-95°C | |
| | Rinse | Rinse | | | | | |
| | Dip Paint or Silane (resist pH⁻3) | Dip Paint or Silane (resist pH⁻3) | | | | | |
| | Rinse | Rinse | | | | | |
| | | | | | | | |
| | Remove sealing jig | Remove sealing jig | | | | | |
| Rinse | Rinse | Rinse | | | | | |
| Nickel plating | Nickel plating | Nickel plating | Watts bath | 2-6A/dm² | 3-5 | 46-71°C | Minutes |
| Rinse | Rinse | Rinse | | | | | |
| Tin plating | Tin plating | Tin plating | Several choices exist - typical acid based | 1-10A/dm² | 2-7 | 20-30°C | minutes |
| Rinse | Rinse | Rinse | | | | | |
| Neutralizing | Neutralizing | Neutralizing | | | | | |
| Rinse | Rinse | Rinse | | | | | |
| Post dip | Post dip | Post dip | | | | | |

30 86

FIG. 7

SYSTEM FOR INSULATING HIGH CURRENT BUSBARS

CROSS-REFERENCE TO RELATED APPLICATIONS

This application is a U.S. National Stage Application under 35 U.S.C. § 371 of International Application No. PCT/US2013/072839, filed Dec. 3, 2013, titled SYSTEM FOR INSULATING HIGH CURRENT BUSBARS, which is hereby incorporated herein by reference in its entirety.

BACKGROUND OF DISCLOSURE

1. Field of Disclosure

Embodiments of the disclosure relate generally to busbars used in equipment racks, and more specifically, to methods of partially insulating high current busbars.

2. Discussion of Related Art

Centralized data centers for computer, communications and other electronic equipment have been in use for a number of years. More recently, with the increasing use of the Internet, large scale data centers that provide hosting services for Internet Service Providers (ISPs), Application Service Providers (ASPs) and Internet content providers have become increasingly popular. It is often desirable to operate equipment within data centers seven days a week, 24 hours per day, with little or no disruption in service. To prevent any disruption in service, it is common practice in data centers to use uninterruptible power supplies (UPSs) to ensure that the equipment within the data centers receives continuous power throughout any black out or brown out periods. Typically, data centers are equipped with a relatively large UPS at the main power distribution panel for the facility. Often, the UPS is selected to have sufficient capacity to meet the power requirements for all of the equipment within the facility.

In certain circumstances, the UPS may require large conductors or busbars, which can carry large currents and high voltages. In some situations, the busbars need to be insulated to avoid short circuits, and in some situations, the busbars need a coating on the contact surfaces due to Underwriters Laboratories (UL) regulations. Presently, there are several methods to insulate busbars. One such method is to apply an epoxy coating to the busbar so that the busbar can withstand high voltages. The coating applied to the surfaces of the busbar is resistant to oxidation over time, and thereby impedes conductivity, which can lead to a thermal runaway. However, epoxy coatings can be expensive. There are many other coatings to insulate the busbar. One such method is to paint the busbar with an anti oxidizing paste before assembly. Another method is to metalize the surface of the busbar with a metal to provide a low contact resistance and avoid excessive oxidation. Silver, tin, and chrome are common metals for surface coating. Typically, the busbar is coated on the full surface. However, coating the busbar with silver, tin or chrome (such as Chrome III) can be expensive as well. Moreover, these processes may not be recognized by UL. Other methods may include sleeves and large air gaps.

Busbars have historically been made from copper, and copper is still a desirable material for busbars. However, due to rising costs of raw material, aluminum has become more common. Unlike copper, which can be used uncoated up to relatively large sizes, aluminum typically requires some form of surface coating on the contact areas due to the quick oxidation of the aluminum surfaces when exposed to air. Coating busbars with epoxy or similar for insulation purposes is a very effective way of adding security and functionality to the busbar, and the technique is state of the art also for medium voltage.

Aluminum has been used as conductors for decades. Also, a process exist today where parts of an aluminum surface are coated with a metal plating for conducting and other parts are anodized (non-conducting). One process employs the use of Chrome III, which is used to metalize the surfaces of the busbar. A special tape may be applied where conducting is intended. Where no tape is applied, insulation is made by removing the Chrome III in a strong acid followed by an anodizing process. Chrome III is not recognized by Underwriters Laboratories as is tin and silver and nickel.

SUMMARY OF DISCLOSURE

One aspect of the present disclosure is directed to a method of treating a surface of an aluminum busbar. In one embodiment, the method comprises: pre-conditioning the surface of the busbar; anodizing one portion of the surface of the busbar; and plating another portion of the surface of the busbar with at least one metal.

Embodiments of the method further may include applying a protective layer on the one portion of the surface of the busbar. The protective layer may be fabricated from PTFE. The sealing jig may be removed after applying the protective layer. The plating process may include plating the another portion of the busbar with at least one zinc coating. The plating process further may include plating the another portion of the busbar with a nickel coating. The plating process further may include plating the another portion of the busbar with a tin coating. The plating process further may include neutralizing the another portion of the busbar, and subjecting the another portion of the busbar to a post dip step. Anodizing one portion of the surface of the busbar may include securing the busbar in a sealing jig. Anodizing one portion of the surface of the busbar further may include de-smutting the busbar with an acid solution. Anodizing one portion of the surface of the busbar further may include applying an anodizing agent. Anodizing one portion of the surface of the busbar further may include coloring the busbar with a water/dye solution and sealing the busbar with water.

Another aspect of the present disclosure is directed to a fixture used to secure a busbar for a treatment process. In one embodiment, the fixture comprises a jig top configured to engage a top surface of the busbar, a jig bottom configured to engage a bottom surface of the busbar, and crab pliers configured to apply a force on the jig top and the jig bottom to secure the busbar in place.

Embodiments of the fixture further may include an anode for performing an anodizing process. The anode may extend through the jig bottom so that an end of the anode is exposed on an upwardly facing surface of the jig bottom. The fixture further may include a directional pin to orient the jig in a correct position. The directional pin may extend from an upwardly facing surface of the jig bottom, with the directional pin being received within an opening formed in the busbar. The fixture further may include a seal provided on a downwardly facing surface of the jig top and a seal provided on an upwardly facing surface of the jig bottom. The crab pliers may be permanently attached to the jig top and jig bottom. The jig top and the jig bottom may be fabricated from solid material with good dimensional stability.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings:

FIG. 3 is a table showing a process flow chart of a method of treating surfaces of a busbar versus processes involving anodizing and tin plating;

FIG. 7 is a table showing a process flow chart of two additional methods for treating surfaces of a busbar.

DETAILED DESCRIPTION

Figure 1:
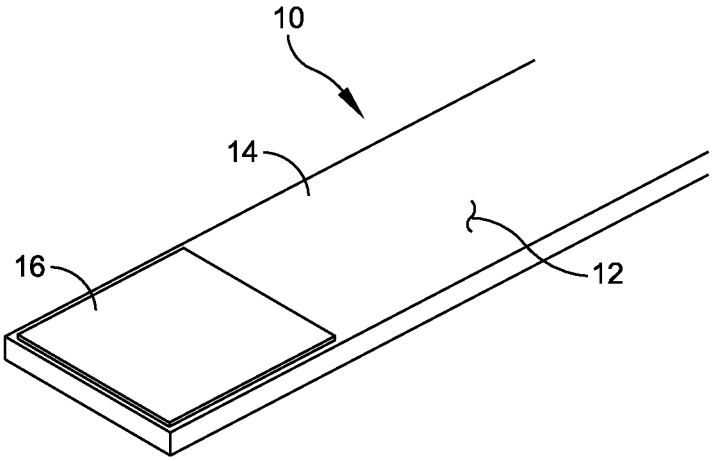
FIG. 1 is a perspective view of a top surface of a portion of a busbar having a treated area.

This disclosure is not limited in its application to the details of construction and the arrangement of components set forth in the following description or illustrated in the drawings. The principles set forth in this disclosure are capable of being provided in other embodiments and of being practiced or of being carried out in various ways. Also, the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

Uninterruptible power supplies are used to provide conditioned and continuous power to equipment provided within data centers, especially throughout any black out or brown out periods. As mentioned above, data centers are equipped with relatively large UPSs at the main power distribution panel for the facility. In certain embodiments, a configurable rack in the form of an uninterruptible power supply includes a frame assembly having a front frame defining a front of the configurable rack, a rear frame defining a rear of the configurable rack, and side frame members that connect the front frame to the rear frame. The frame assembly is a box-shaped structure having, in addition to the front and back, two sides, a top and a bottom. The front frame and the rear frame are each configured to receive electronic modules in stacked relation along a height of the frame. In certain embodiments, the modules may be rack-mounted or mounted on rails or slides within the interior of the frame assembly. The configurable rack may include power modules and batteries to form an uninterruptible power supply, and other pieces of equipment required to operate the uninterruptible power supply. These modules are rack-mounted in the well-known manner.

Busbars may be used to provide power to the modules positioned within the configurable rack. Busbars are also used in many electrical power distribution devices, such as power modules, switching apparatus, distribution apparatus, and batteries. In certain embodiments, the busbar may be configured as a strip or bar of conductive material, such as copper, aluminum, or brass. A primary purpose of the busbar is to conduct electricity. A cross-sectional size of the busbar may be selected to determine a maximum amount of current that can be safely carried. Busbars can be configured to small or large cross-sectional areas. Busbars are typically either flat strips or hollow tubes as these shapes allow heat to dissipate more efficiently due to their high surface area to cross-sectional area ratio. Reference can be made to U.S. Patent Application Publication No. 2012/0170175 A1, which discloses a configurable rack having a busbar backplane to provide power to modules positioned within the configurable rack.

Figure 2:
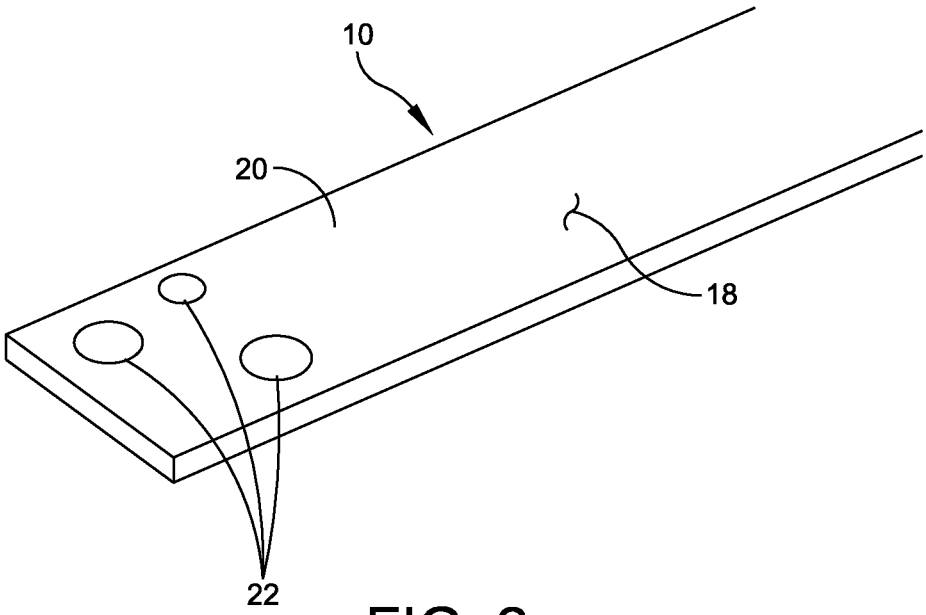
FIG. 2 is a perspective view of a bottom surface of the portion of the busbar having a treated area.

A busbar may either be supported on insulators, or else insulation may completely or partially surround an exterior surface of the busbar. One or more techniques of the present disclosure are directed to adding insulation to aluminum busbars with the use of anodizing and plating to the busbars in select contact areas. Contact areas are defined as areas that are bolted against other busbars, cables or similar constructions. The insulating properties of anodized aluminum are to be considered as a ceramic insulator, which can be combined with other insulators. An object of the present disclosure is to create a relatively inexpensive insulated busbar that can be bolted to other aluminum busbars or to copper busbars without electro-galvanic issues and that can occur with known plating processes. FIG. 1 illustrates a portion of a busbar generally indicated at 10 having a top surface 12 with an anodized are 14 and a tin plated area 16. As shown, the tin plated area 16 covers the entire top surface at the end of the busbar 10. FIG. 2 illustrates a bottom surface 18 of the portion of the busbar 10 having an anodized area 20 and discrete tin plated areas each indicated at 22.

Referring to FIG. 3, one embodiment of a method of treating a busbar is generally indicated at 30. As shown, the method includes a pre-conditioning process generally indicated at 32, an anodizing process generally indicated at 34, a PTFE application step generally indicated at 36, and a plating process generally indicated at 38. Combine anodizing and plating processes into a simple process flow line so degreasing, etching and de-smutting is shared for both processes. In one embodiment, the pre-conditioning process 32 includes degreasing the busbar with a mild alkaline having a pH of about 12 at a temperature of 50° C. to 80° C. for 60 to 300 seconds. Next, the busbar is rinsed with an appropriate rinsing solution. The pre-conditioning process 32 further includes an alkaline etch with a strong alkaline having a pH of about greater than 13 at a temperature of 60° C. to 70° for 5 to 120 seconds. Next, the busbar is rinsed to conclude the pre-conditioning process 32. The pre-conditioning process 32 ensures that the busbars are kept continuously kept wet (wet in wet) from the start of the process to the end of the process.

Next, the busbar is treated by the anodizing process 34. However, prior to going through anodizing, the busbar is held in place by a fixture or sealing jig, which, in one embodiment, is a spring-loaded device that suspends the busbar during the anodizing process 34. The sealing jig is configured to perform within a wet environment so that the busbar is continuously wet during activation and deactivation, and to expose select areas for anodizing. A description of the sealing jig will be provided with reference to FIGS. 4 and 5, below.

In the anodizing process 34, exposed aluminum develops by nature a thin layer of aluminum oxide on surfaces of the aluminum busbar that is non conductive. In many instances, the aluminum busbars are joined together with a deoxidizing gel that removes this oxide layer before joining the busbars together. UL allows these joining to be up to 75° C. during type approval of a product. In one embodiment, the method 30 includes a mixed combination of surface treatments that make it possible to assign conductivity or non-conductivity to the surface of aluminum busbars by use of the sealing jigs, and a mixture of two coating techniques. The anodizing process 34 is a process to make the selected surface or surfaces of the aluminum busbar non-conductive. The natural oxide layer may be electrically reinforced and made thicker. UL recognizes anodizing as a ceramic insulation, and is therefore deemed a very safe and reliable insulator.

It should be understood that the anodizing process 34 may include any suitable process to anodize the selected surfaces of the busbar, and still provide the beneficial effects desired. With any anodizing process 34, the busbar requires cleaning, in either a hot soap cleaner or in a solvent bath, and may be etched or brightened in a mix of acids. The anodized aluminum layer is grown by passing a direct current through the anodizing step through an electrolytic solution, with the aluminum busbar serving as the anode (the positive electrode). The current releases hydrogen at the cathode (the negative electrode) and oxygen at the surface of the aluminum anode, thereby creating a build-up of aluminum oxide on the surface of the busbar. Aluminum anodizing is usually performed in an acid solution, which slowly dissolves the aluminum oxide. The acid action is balanced with the oxidation rate to form a coating with nanopores, which are often filled with colored dyes and/or corrosion inhibitors before sealing.

As shown in FIG. 3, in one embodiment, the anodizing process 34 includes de-smutting the selected surfaces of the busbar with an acid solution having a pH value less than 1. In certain embodiments, the acid solution is nitric acid ($HNO_3$) having a solution concentration of approximately 50%. Next, the surfaces of the busbar are rinsed with an appropriate rinsing solution. The surfaces of the busbar are next subjected to an anodizing agent having a pH of approximately 1 at 20° C. at a current of 1.2 to 2 A/dm$^2$ for one or more minutes. In certain embodiments, the anodizing agent is sulfuric acid ($H_2SO_4$) having a solution concentration of approximately 20%. The anodizing process 34 further includes rinsing the busbar with an appropriate solution, and coloring the busbar with a water/dye solution having a pH between 7 and 8 at 20° C. And finally, the anodizing process 34 includes rinsing the busbar with an appropriate solution, sealing the busbar with water having a pH between 7 and 8 at a temperature of 80° C. to 95° C., and performing a final rinsing step on the busbar.

As discussed, the anodizing process 34 is performed with the busbar being held in place by the sealing jig configured to expose selected surfaces of the busbar for anodizing. After the anodizing process 34, a PTFE layer, or some other similar product, is applied during the PTFE application step 36 on top of the surfaces treated by the anodizing process. The PTFE layer prevents the anodized treated surface from being eaten away by the stripping step of the plating process, which will be described in greater detail below. After applying the PTFE layer, the sealing jig is removed to enable the application of the plating process.

Still referring to FIG. 3, the plating process 38 includes plating the busbar with two zinc coatings, a nickel coating and a tin coating. The zinc coatings act as an enabler for metallization. Nickel plating provides a more uniform layer thickness over the surface of the busbar. Nickel plating is self-catalyzing process; the resultant nickel layer is a NiP compound. The ductility of the tin enables a tin-coated base metal sheet to be formed into a variety of shapes without damage to the surface tin layer. It provides sacrificial protection for the aluminum busbar.

In one embodiment, the plating process 38 includes rinsing the busbar. Next, the busbar is subjected to a zinc plating step. In one embodiment, the zinc plating solution includes an alzincate EN solution having a pH greater than 12 at a temperature of 21° C. to 46° C. for 15 to 120 seconds. The busbar is rinsed again, and then subjected to stripping step, which includes stripping the busbar within a nitric acid ($HNO_3$) bath having a solution concentration of 50% with a pH approximately 1 at a temperature of 20° C. for 5 to 10 seconds. The plating process 38 further includes rinsing the busbar, and subjecting the busbar to another zinc plating step, which is the same as the zinc plating step described above.

In one embodiment, the plating process 38 further includes rinsing the busbar again, and subjecting the busbar to a nickel plating step. The nickel plating step includes plating the busbar in a nickel bath, e.g., a Watts bath, having a 2 to 6 A/dm$^2$ at a temperature of 46° C. to 71° C. for one to several minutes. The plating process 38 further includes rinsing the busbar again, and subjecting the busbar to a tin plating step. The tin plating step includes plating the busbar in a tin bath having a to 10 A/dm$^2$ at a temperature of 20° C. to 30° C. for one to several minutes. And finally, the plating process 38 further includes rinsing the busbar, neutralizing the busbar, rinsing the busbar again, and subjecting the busbar to a post dip step.

In other embodiments, as mentioned above, the PTFE layer is optional, since the anodized surfaces are capable of withstanding the plating step.

Tin coatings, including the nickel and zinc undercoatings, are recognized coatings by the UL. The UL allows tin coated surfaces to be subjected to temperatures up to 90° C., which enables less material usage. Also, tin coated aluminum can be joined with tin coated copper busbars without further restrictions. Also, of particular interest regarding production setup, is that tin is applied as a part of manufacturing whereas a deoxidizing gel would be applied in assembly. The difference in this is where responsibility is placed and how inspection and quality assurance procedures are setup.

Common for anodizing and tin coating the busbar is that both properties offer good protection against corrosion and show long term stability. Embodiments of the method include steps of anodizing and tin coating. It should be understood that methods of the embodiments disclosed herein may be applied to treating copper busbars, with the exception that anodizing on copper is not possible; however, the tin coating may be applied where desired.

Figure 4:
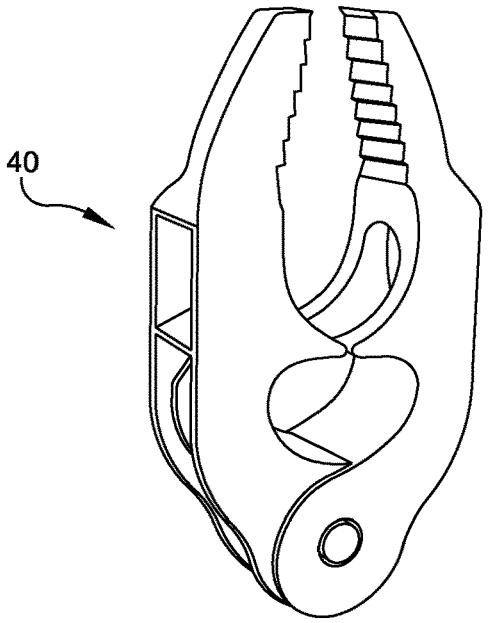
FIG. 4 is a perspective view of crab pliers used to perform the method of treating surfaces of the busbar.
Figure 5:
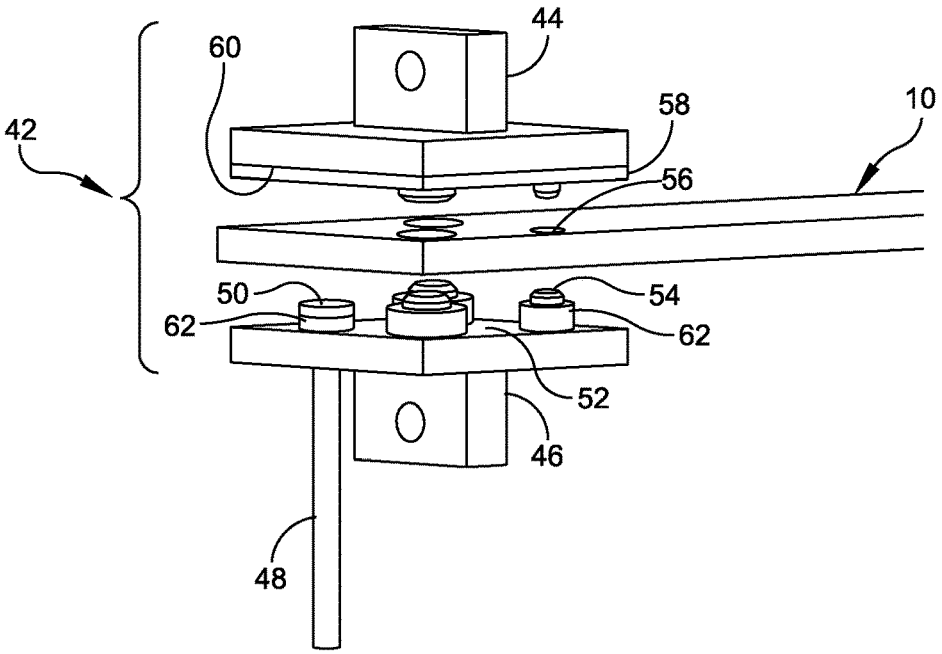
FIG. 5 is a perspective view of a jig shown prior to being secured to an end of the busbar.
Figure 6:
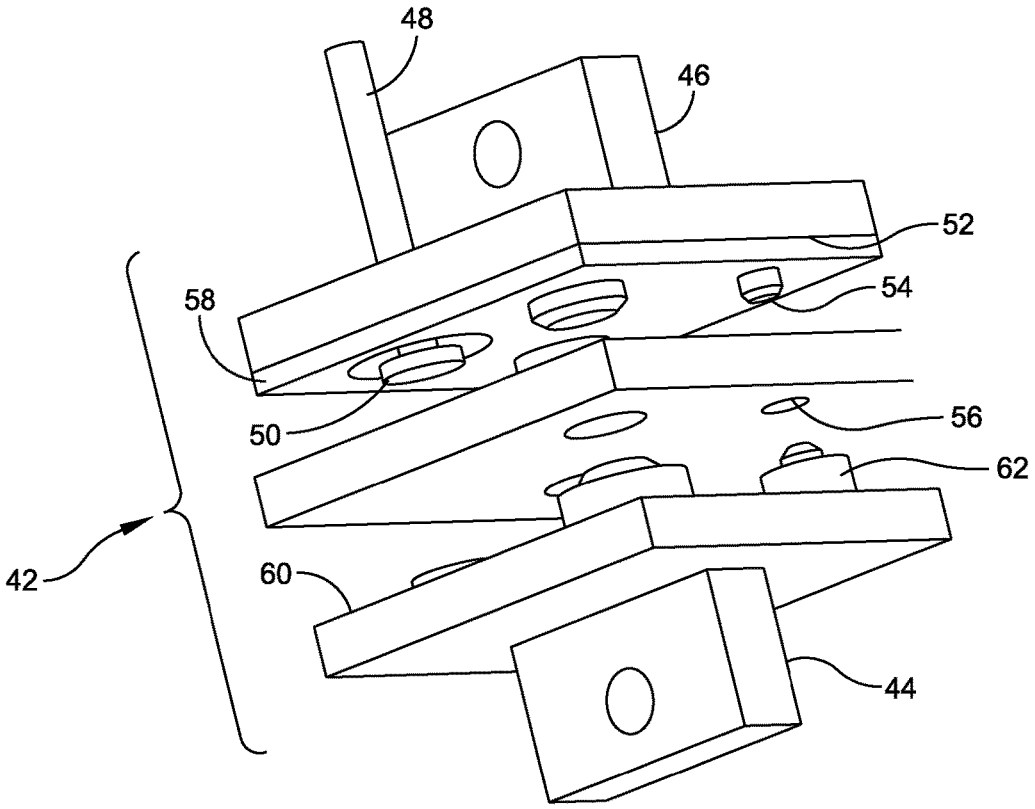
FIG. 6 is a perspective view of the jig showing an exposed anode.

Referring to FIGS. 4-6, and more particularly to FIG. 4, the sealing jig includes the use of crab pliers, generally indicated at 40, which can withstand the harsh environment of steps the anodizing process 34. In one embodiment, the crab pliers 40 are fabricated from hard plastic that is resistant to harsh chemicals. Crab pliers 40 are readily available at a reasonable cost. The crab pliers 40 are used to hold together the components of a sealing jig, generally indicated at 42, which is shown in FIGS. 5 and 6. As shown, the jig 42 includes a jig top 44 and a jig bottom 44. The crab pliers 40 are able hold the jig top 44 and the jig bottom 46 together over the busbar 10. Further, the crab pliers 40, if properly sized, are capable of applying a sufficient force to ensure that the sealing will provide tightness during the anodizing process 34. With minor modifications, the crab pliers 40 can have the jig top 44 and jig bottom 46 permanently attached to them, so that the crab pliers consist of an assembly that can easily be applied onto the busbar 10. One benefit of this embodiment is that the sealing jig 42 allows the anodizing process 34 to be carried out in a wet environment. This construction ensures that the busbars are kept wet throughout the entire coating cycle.

In one embodiment, the jig top 44 and the jig bottom 46 of the sealing jig 42 may be fabricated from solid material with good dimensional stability. Also, material used to fabricate the jig top 44 and the jig bottom 46 must be able to withstand the conditions (pH and temperature) applied to the busbar 10 during the anodizing process 34. In one embodiment, the jig top 44 and the jig bottom are fabricated from hard plastic that is resistant to harsh chemicals. The sealing jig 42 further includes an anode 48 for the anodizing process 34. As shown, the anode 48 extends through the jig bottom 46 so that an end or tip 50 of the anode is exposed on an upwardly facing surface 52 of the jig bottom. The current required for the anodizing process 34 can be built into the sealing jig 42 as well. The crab pliers 40 may provide a force sufficient to ensure good electrical contact between the tip 50 of the anode 48 and busbar 10. The anode 48 is likely to be made of titanium or other precious materials.

The sealing jig 42 further includes a directional pin 54, which is provided to ensure that orientation of the sealing jig is correct. As shown, the directional pin 54 extends from the upwardly facing surface 52 of the jig bottom 46. This arrangement ensures that the jig top 44 and jig bottom 46 are not reversed in error. An opening 56 is formed in the busbar 10 for the directional pin 54. After the sealing jig 42 is removed, the opening 56 can be used to receive the nickel and tin coating anodes that are used in the plating process 38. The opening 56 serves no other purpose on the finished busbar. The sealing jig 42 further includes a seal 58 provided on a downwardly facing surface 60 of the jig top 44 and several seals, each indicated at 62, which can be used to seal the anode 48 and the directional pin 54 with respect to the jig bottom 46. The seals 58, 62 can be fabricated from PTFE material, is commonly used for sealing and is able to withstand pH and temperature requirements. Other alternatives exist.

One disadvantage associated with sealing jig 42 is that the anode 48 for anodizing process 34 may be coated with the non-conductive PTFE. This may not be desirable since the PTFE material may prevent the anode 48 from being continuously reused. To prevent the anode 48 from being coated, the anode may be integrated into the jig top 44 in a way so the seal for the jig bottom 46 offers the required protection. As shown, the anode 48 is exposed. However, this issue is easily solved by integrating the anode 48 with the jig top 44.

FIG. 7 illustrates two alternative embodiments to the method 30 shown and described with respect to FIG. 3. In one embodiment, a method, generally indicated at 70, includes a pre-conditioning process generally indicated at 72, an anodizing process generally indicated at 74, and an optional plating process generally indicated at 76. As shown, the pre-conditioning process 72 is identical to the pre-conditioning process 32 shown in FIG. 3 with respect to method 30.

Next, the busbar is treated by the anodizing process 74. As shown, the busbar is not held in place by the sealing jig. The anodizing process 74 includes de-smutting the busbar with an acid solution having a pH value less than 1. In certain embodiments, the acid solution is nitric acid ($HNO_3$) having a solution concentration of approximately 50%.

After rinsing the busbar, the busbar is subjected the plating process 76. In one embodiment, the plating process 76 includes a zinc plating step. The zinc plating solution includes an alzincate EN solution having a pH greater than 12 at a temperature of 21° C. to 46° C. for 15 to 120 seconds. The busbar is rinsed again, and then subjected to stripping step, which includes stripping the busbar within a nitric acid ($HNO_3$) bath having a solution concentration of 50% with a pH approximately 1 at a temperature of 20° C. for 5 to 10 seconds. The plating process 76 further includes rinsing the busbar, and subjecting the busbar to another zinc plating step, which is the same as the zinc plating step described above.

After applying the zinc coatings, the busbar is rinsed and then held in place by the sealing jig. After another rinse and de-smutting steps, the busbar is rinsed and then subjected to an anodizing agent having a pH of approximately 1 at 20° C. at a current of 1.2 to 2 A/dm$^2$ for one or more minutes. In certain embodiments, the anodizing agent is sulfuric acid ($H_2SO_4$) having a solution concentration of approximately 20%. The plating process 76 further includes rinsing the busbar with an appropriate solution, and coloring the busbar with a water/dye solution having a pH between 7 and 8 at 20° C. The plating process 76 further includes rinsing the busbar with an appropriate solution, sealing the busbar with water having a pH between 7 and 8 at a temperature of 80° C. to 95° C., and performing a final rinsing step on the busbar. After sealing and rinsing, the busbar is dipped in paint or a silane solution having a pH of approximately 3. Next, the busbar is rinsed and removed from the sealing jig.

The optional plating process 76 further includes rinsing the busbar again, and subjecting the busbar to a nickel plating step. When employed, the nickel plating step of the plating process 76 includes plating the busbar in a nickel bath, e.g., a Watts bath, having a 2 to 6 A/dm$^2$ at a temperature of 46° C. to 71° C. for one to several minutes. The optional plating process 76 further includes rinsing the busbar again, and subjecting the busbar to a tin plating step. The tin plating step includes plating the busbar in a tin bath having a to 10 A/dm$^2$ at a temperature of 20° C. to 30° C. for one to several minutes. And finally, the optional plating process 76 further includes rinsing the busbar, neutralizing the busbar, rinsing the busbar again, and subjecting the busbar to a post dip step.

FIG. 7 illustrates another method, generally indicated at 80, which includes a pre-conditioning process generally indicated at 82, an anodizing process generally indicated at 84, and an optional plating process generally indicated at 86. As shown, the pre-conditioning process 82 is identical to the pre-conditioning processes 32, 72 described with respect to methods 30, 70, respectively. After the pre-conditioning process 82, the busbar is the treated by the anodizing process 84. The anodizing process 84 includes de-smutting the busbar with an acid solution having a pH value less than 1. In certain embodiments, the acid solution is nitric acid ($HNO_3$) having a solution concentration of approximately 50%. Next, the busbar is rinsed.

After rinsing the busbar, the busbar is held in place by the sealing jig. After another rinsing step, the busbar is dipped in paint or a silane solution having a pH of approximately 3. Next, the busbar is rinsed and removed from the sealing jig. When employed, the plating process 86 includes rinsing the busbar again, and subjecting the busbar to a nickel plating step. The nickel plating step includes plating the busbar in a nickel bath, e.g., a Watts bath, having a 2 to 6 A/dm$^2$ at a temperature of 46° C. to 71° C. for one to several minutes. The optional plating process 86 further includes rinsing the busbar again, and subjecting the busbar to a tin plating step. The tin plating step includes plating the busbar in a tin bath having a to 10 A/dm$^2$ at a temperature of 20° C. to 30° C. for one to several minutes. And finally, the optional plating process 86 further includes rinsing the busbar, neutralizing the busbar, rinsing the busbar again, and subjecting the busbar to a post dip step.

It should be observed that methods of treating busbars disclosed herein involve tin, which is an acceptable metal that is used in the UPS industry. In the methods, the coating is applied only to conducting surfaces. Therefore, less waste of coating products may be achieved. Moreover, when compared to prior full coating processes, the methods disclosed herein exhibit the ability to reduce space usage (more compact products) and higher design freedom since busbars can be placed closer to each others. Arch flash events tend to propagate, so one flash can start new flashes that lead to severe damage inside a cabinet. Non-conducting surfaces may significantly limit how an arch flash can propagate, which in turn will provide reduced warranty cost. Short circuits also may be prevented from propagating because busbars can deflect and touch each other without consequence (formation of a new short circuit). If the coating peels off or whiskers are formed, then free particles of conducting material may flow freely inside the cabinet. By applying the coating only on surfaces where strictly needed, the amount of free particles that are formed can be eliminated or significantly reduced.

Having thus described several aspects of at least one embodiment of this disclosure, it is to be appreciated various alterations, modifications, and improvements will readily occur to those skilled in the art. Such alterations, modifications, and improvements are intended to be part of this disclosure, and are intended to be within the spirit and scope of the disclosure. Accordingly, the foregoing description and drawings are by way of example only.

What is claimed is:

1. A method of treating a surface of an aluminum busbar, the method comprising:

pre-conditioning the surface of the busbar;

anodizing one portion of the surface of the busbar; and plating another portion of the surface of the busbar with at least one metal, wherein anodizing one portion of the surface of the busbar includes securing the busbar in a sealing jig to expose the one portion of the surface of the busbar, the sealing jig including a jig top having a planar downwardly facing surface configured to engage a top surface of the busbar, a jig bottom having a planar upwardly facing surface configured to engage a bottom surface of the busbar, and crab pliers configured to apply a force on the jig top and the jig bottom to secure the busbar in place, the sealing jig further including a cylindrical anode for performing an anodizing process, the anode having a cylindrical tip having a diameter larger than a diameter of the anode, a directional pin to orient the sealing jig in a correct position, a first seal provided on the planar downwardly facing surface of the jig top, and a second seal provided on the planar upwardly facing surface of the jig bottom and configured to seal the anode adjacent the tip with respect to the jig bottom, and a third seal provided on the planar upwardly facing surface of the jig bottom and configured to seal the directional pin with respect to the jig bottom, the anode extending through the jig bottom so that the anode extends from a downwardly facing surface of the jig bottom to the planar upwardly facing surface of the jig bottom to expose the tip of the anode on the planar upwardly facing surface of the jig bottom, the directional pin extending from the planar upwardly facing surface of the jig bottom, the directional pin being received within an opening formed in the busbar.

2. The method of claim 1, wherein anodizing one portion of the surface of the busbar further includes de-smutting the busbar with an acid solution.

3. The method of claim 2, wherein anodizing one portion of the surface of the busbar further includes applying an anodizing agent.

4. The method of claim 3, wherein anodizing one portion of the surface of the busbar further includes coloring the busbar with a water/dye solution and sealing the busbar with water.

5. The method of claim 1, further comprising applying a protective layer on the one portion of the surface of the busbar.

6. The method of claim 5, wherein the protective layer is fabricated from PTFE.

7. The method of claim 5, wherein the sealing jig is removed after applying the protective layer.

8. The method of claim 5, wherein the plating process includes plating the another portion of the busbar with at least one zinc coating.

9. The method of claim 8, wherein the plating process further includes plating the another portion of the busbar with a nickel coating.

10. The method of claim 9, wherein the plating process further includes plating the another portion of the busbar with a tin coating.

11. The method of claim 10, wherein the plating process further includes neutralizing the another portion of the busbar, and subjecting the another portion of the busbar to a post dip step.

* * * * *